US008782967B2

(12) United States Patent
Daniels

(10) Patent No.: US 8,782,967 B2
(45) Date of Patent: Jul. 22, 2014

(54) ABOVE SHEATHING VENTILATION SYSTEM

(76) Inventor: Gregory S. Daniels, Santa Rosa, CA (US)

( * ) Notice: Subject to any disclaimer, the term of this patent is extended or adjusted under 35 U.S.C. 154(b) by 0 days.

(21) Appl. No.: 13/236,267

(22) Filed: Sep. 19, 2011

(65) Prior Publication Data

US 2012/0073216 A1 Mar. 29, 2012

Related U.S. Application Data

(60) Provisional application No. 61/386,886, filed on Sep. 27, 2010.

(51) Int. Cl.
*E04D 13/17* (2006.01)

(52) U.S. Cl.
USPC ..... 52/95; 52/198; 52/302.1; 454/250

(58) Field of Classification Search
CPC ... E04D 13/158; E04D 13/174; E04D 13/178; F24F 7/02
USPC ..... 52/95, 96, 198, 199, 302.1, 302.3, 52/302.6, 302.4; 454/250, 260, 364, 365, 454/366, 367, 368
See application file for complete search history.

(56) References Cited

U.S. PATENT DOCUMENTS

| | | | |
|---|---|---|---|
| 2,343,764 | A | 3/1944 | Fuller |
| 2,638,835 | A | 5/1953 | Strawsine |
| 2,733,649 | A | 2/1956 | LeBarron |
| 3,027,090 | A | 3/1962 | Zerhan, Jr. |
| 3,311,047 | A | 3/1967 | Smith et al. |
| 3,368,473 | A | 2/1968 | Sohda et al. |
| 3,376,164 | A | 4/1968 | Baehwansky et al. |

(Continued)

FOREIGN PATENT DOCUMENTS

| | | |
|---|---|---|
| DE | 28 04 301 | 8/1979 |
| DE | 31 32 152 | 6/1982 |

(Continued)

OTHER PUBLICATIONS

Advisory Action dated Nov. 14, 2008 in U.S. Appl. No. 11/736,498, filed Apr. 17, 2007.

(Continued)

*Primary Examiner* — Jeanette E Chapman
*Assistant Examiner* — James Buckle, Jr.
(74) *Attorney, Agent, or Firm* — Knobbe Martens Olson & Bear LLP

(57) ABSTRACT

A roof structure and a vented eave riser are described. A vented eave riser can include a barrier wall with one or more air flow openings, and an ember impedance structure positioned proximate to the barrier wall. A roof structure may comprise a roof deck and a layer of roof cover elements spaced above the roof deck to form an air layer between the roof deck and the roof cover elements. The roof structure may also comprise one or more vent members each replacing and mimicking an appearance of one or more roof cover elements of the layer of roof cover elements, and/or at least one vented eave riser positioned at an eave between the roof deck and the layer of roof cover elements. The vent members and/or the vented eave riser may further include an ember impedance structure, such as a fire-resistant mesh material or a baffle structure.

2 Claims, 12 Drawing Sheets

(56) References Cited

U.S. PATENT DOCUMENTS

| | | | | |
|---|---|---|---|---|
| 3,598,688 | A | 8/1971 | Bellamy | |
| 3,685,596 | A | 8/1972 | Collins | |
| 3,780,872 | A | 12/1973 | Pall | |
| 3,951,336 | A | 4/1976 | Miller et al. | |
| 4,040,867 | A | 8/1977 | Forestieri et al. | |
| 4,083,097 | A | 4/1978 | Anagnostou et al. | |
| 4,097,308 | A | 6/1978 | Klein et al. | |
| 4,189,881 | A | 2/1980 | Hawley | |
| 4,201,121 | A | 5/1980 | Brandenburg | |
| 4,224,081 | A | 9/1980 | Kawamura et al. | |
| 4,228,729 | A | 10/1980 | Messick | |
| 4,239,555 | A | 12/1980 | Scharlack et al. | |
| 4,251,026 | A | 2/1981 | Siegel et al. | |
| 4,314,548 | A | 2/1982 | Hanson | |
| 4,382,435 | A | 5/1983 | Brill-Edwards | |
| 4,383,129 | A | 5/1983 | Gupta et al. | |
| 4,432,273 | A | 2/1984 | Devitt | |
| 4,433,200 | A | 2/1984 | Jester et al. | |
| 4,574,160 | A | 3/1986 | Cull et al. | |
| 4,602,739 | A | 7/1986 | Sutton, Jr. | |
| D285,829 | S | 9/1986 | Lock | |
| 4,625,469 | A | 12/1986 | Gentry et al. | |
| 4,692,557 | A | 9/1987 | Samuelson et al. | |
| 4,759,272 | A | 7/1988 | Zaniewski | |
| 4,803,816 | A | 2/1989 | Klober | |
| 4,843,794 | A | 7/1989 | Holtgreve | |
| 4,850,166 | A | 7/1989 | Taylor | |
| 4,965,971 | A | 10/1990 | Jean-Jacques et al. | |
| 4,977,818 | A | 12/1990 | Taylor et al. | |
| 4,986,469 | A | 1/1991 | Sutton, Jr. | |
| 4,995,308 | A | 2/1991 | Waggoner et al. | |
| 5,048,225 | A | 9/1991 | Brandli | |
| 5,049,801 | A | 9/1991 | Potter | |
| 5,060,444 | A | 10/1991 | Paquette | |
| 5,078,047 | A | 1/1992 | Wimberly | |
| 5,095,810 | A | 3/1992 | Robinson | |
| 5,122,095 | A | 6/1992 | Wolfert | |
| 5,131,200 | A | 7/1992 | McKinnon | |
| 5,131,888 | A | 7/1992 | Adkins, II | |
| 5,167,579 | A | 12/1992 | Rotter | |
| 5,228,925 | A | 7/1993 | Nath et al. | |
| 5,232,518 | A | 8/1993 | Nath et al. | |
| 5,296,043 | A | 3/1994 | Kawakami et al. | |
| 5,316,592 | A | 5/1994 | Dinwoodie | |
| 5,333,783 | A | 8/1994 | Catan | |
| 5,364,026 | A | 11/1994 | Kundert | |
| 5,391,235 | A | 2/1995 | Inoue | |
| 5,427,571 | A | 6/1995 | Sells et al. | |
| 5,458,538 | A | 10/1995 | MacLeod et al. | |
| 5,480,494 | A | 1/1996 | Inoue | |
| 5,486,238 | A | 1/1996 | Nakagawa et al. | |
| 5,505,788 | A | 4/1996 | Dinwoodie | |
| 5,528,229 | A | 6/1996 | Mehta | |
| 5,620,368 | A | 4/1997 | Bates et al. | |
| 5,697,192 | A | 12/1997 | Inoue | |
| 5,706,617 | A | 1/1998 | Hirai et al. | |
| 5,722,887 | A | 3/1998 | Wolfson et al. | |
| 5,740,636 | A | 4/1998 | Archard | |
| 5,746,653 | A | 5/1998 | Palmer et al. | |
| 5,746,839 | A | 5/1998 | Dinwoodie | |
| 5,772,502 | A | 6/1998 | Smith | |
| 5,814,118 | A | 9/1998 | Wickland et al. | |
| 5,890,322 | A | 4/1999 | Fears | |
| 5,971,848 | A | 10/1999 | Nair | |
| 5,990,414 | A | 11/1999 | Posnansky | |
| 6,008,450 | A | 12/1999 | Ohtsuka et al. | |
| 6,050,039 | A | 4/2000 | O'Hagin | |
| 6,051,774 | A | 4/2000 | Yoshida et al. | |
| 6,061,978 | A | 5/2000 | Dinwoodie et al. | |
| 6,077,159 | A | 6/2000 | Clayton | |
| 6,105,317 | A | 8/2000 | Tomiuchi et al. | |
| 6,129,628 | A | 10/2000 | O'Hagin et al. | |
| 6,155,006 | A | 12/2000 | Mimura et al. | |
| 6,220,956 | B1 | 4/2001 | Killian et al. | |
| 6,227,963 | B1 | 5/2001 | Headrick | |
| 6,241,602 | B1 * | 6/2001 | Allen | 454/280 |
| 6,242,685 | B1 | 6/2001 | Mizukami | |
| 6,243,995 | B1 * | 6/2001 | Reeves et al. | 52/94 |
| 6,277,024 | B1 | 8/2001 | Coulton | |
| 6,286,273 | B1 | 9/2001 | Villela et al. | |
| 6,294,724 | B1 | 9/2001 | Sasaoka et al. | |
| 6,306,030 | B1 | 10/2001 | Wilson | |
| 6,308,473 | B1 | 10/2001 | Auck | |
| 6,336,304 | B1 | 1/2002 | Mimura et al. | |
| 6,361,434 | B1 | 3/2002 | Brandon | |
| 6,365,824 | B1 | 4/2002 | Nakazima et al. | |
| 6,371,847 | B2 | 4/2002 | Headrick | |
| 6,390,914 | B1 | 5/2002 | O'Hagin et al. | |
| 6,415,559 | B1 * | 7/2002 | Reeves et al. | 52/94 |
| 6,418,678 | B2 * | 7/2002 | Rotter | 52/199 |
| 6,439,466 | B2 | 8/2002 | Fikes | |
| 6,447,390 | B1 | 9/2002 | O'Hagin | |
| 6,453,629 | B1 | 9/2002 | Nakazima et al. | |
| 6,491,579 | B1 | 12/2002 | O'Hagin | |
| 6,501,013 | B1 | 12/2002 | Dinwoodie | |
| 6,541,693 | B2 | 4/2003 | Takada et al. | |
| 6,571,522 | B1 | 6/2003 | Perini | |
| 6,606,830 | B2 | 8/2003 | Nagao et al. | |
| 6,695,692 | B1 | 2/2004 | York | |
| 6,780,099 | B1 | 8/2004 | Harper | |
| 6,799,742 | B2 | 10/2004 | Nakamura et al. | |
| 6,870,087 | B1 | 3/2005 | Gallagher | |
| 6,941,706 | B2 * | 9/2005 | Austin et al. | 52/94 |
| 7,024,828 | B2 | 4/2006 | Headrick | |
| 7,053,294 | B2 | 5/2006 | Tuttle et al. | |
| 7,101,279 | B2 | 9/2006 | O'Hagin | |
| 7,178,295 | B2 | 2/2007 | Dinwoodie | |
| 7,250,000 | B2 | 7/2007 | Daniels, II | |
| D549,316 | S | 8/2007 | O'Hagin et al. | |
| 7,320,774 | B2 | 1/2008 | Simmons et al. | |
| 7,469,508 | B2 | 12/2008 | Ceria | |
| 7,506,477 | B2 | 3/2009 | Flaherty et al. | |
| 7,509,775 | B2 | 3/2009 | Flaherty et al. | |
| 7,531,740 | B2 | 5/2009 | Flaherty et al. | |
| 7,540,118 | B2 | 6/2009 | Jensen | |
| 7,578,102 | B2 | 8/2009 | Banister | |
| 7,587,864 | B2 | 9/2009 | McCaskill et al. | |
| 7,618,310 | B2 | 11/2009 | Daniels | |
| 7,642,449 | B2 | 1/2010 | Korman et al. | |
| 7,678,990 | B2 | 3/2010 | McCaskill et al. | |
| 7,736,940 | B2 | 6/2010 | Basol | |
| 7,882,670 | B2 | 2/2011 | West | |
| 2001/0027804 | A1 | 10/2001 | Inoue et al. | |
| 2002/0086634 | A1 | 7/2002 | Sells | |
| 2003/0159802 | A1 | 8/2003 | Steneby et al. | |
| 2004/0098932 | A1 | 5/2004 | Broatch | |
| 2005/0191957 | A1 | 9/2005 | Demetry et al. | |
| 2005/0239393 | A1 | 10/2005 | Reese | |
| 2005/0239394 | A1 | 10/2005 | O'Hagin et al. | |
| 2006/0052047 | A1 | 3/2006 | Daniels | |
| 2006/0052051 | A1 | 3/2006 | Daniels, II | |
| 2006/0213767 | A1 | 9/2006 | Anaf | |
| 2006/0240763 | A1 | 10/2006 | Takeda | |
| 2007/0067063 | A1 | 3/2007 | Ahmed | |
| 2007/0072541 | A1 | 3/2007 | Daniels et al. | |
| 2007/0094953 | A1 * | 5/2007 | Galeazzo et al. | 52/198 |
| 2007/0173191 | A1 | 7/2007 | Daniels, II et al. | |
| 2007/0207725 | A1 | 9/2007 | O'Hagin | |
| 2007/0243820 | A1 | 10/2007 | O'Hagin | |
| 2007/0275652 | A1 | 11/2007 | Berkompas | |
| 2008/0098672 | A1 | 5/2008 | O'Hagin et al. | |
| 2008/0220714 | A1 * | 9/2008 | Caruso et al. | 454/365 |
| 2008/0299892 | A1 | 12/2008 | Robinson | |
| 2009/0203308 | A1 | 8/2009 | Daniels | |
| 2009/0286463 | A1 | 11/2009 | Daniels | |
| 2010/0229940 | A1 | 9/2010 | Basol | |
| 2012/0073216 | A1 | 3/2012 | Daniels | |
| 2012/0110924 | A1 * | 5/2012 | Makin | 52/58 |

FOREIGN PATENT DOCUMENTS

| | | |
|---|---|---|
| DE | 198 23 356 | 11/1999 |
| FR | 2 324 823 | 4/1977 |
| GB | 805978 | 12/1958 |

(56) References Cited

FOREIGN PATENT DOCUMENTS

| | | |
|---|---|---|
| GB | 2 183 819 | 6/1987 |
| GB | 2 211 287 | 6/1989 |
| GB | 2 279 453 | 1/1995 |
| GB | 2 345 536 | 7/2000 |
| JP | 59-60138 | 4/1984 |
| JP | 06-241517 | 8/1994 |
| JP | 06-272920 | 9/1994 |
| JP | 09-158428 | 6/1997 |
| JP | 10-061133 | 3/1998 |
| JP | 11-044035 | 2/1999 |
| JP | 11-229576 | 8/1999 |
| JP | 2000-274032 | 10/2000 |
| JP | 2004-092298 | 3/2004 |
| JP | 2007-534924 | 11/2007 |
| WO | WO 01/40568 | 6/2001 |
| WO | WO 2005-108708 | 11/2005 |
| WO | WO 2011/126773 | 10/2011 |

OTHER PUBLICATIONS

"Building Materials Listing Program," Office of the State Fire Marshal—Fire Engineering—BML Program, http://osfm.fire.ca.gov/bml.html, Printed Feb. 27, 2008, 2 pages.

Final Office Action dated Jul. 25, 2008 in U.S. Appl. No. 11/736,498, filed Apr. 17, 2007.

"Grill Screens," foodservicedirect.com, http://www.foodservicedirect.com/index.cfm/S/107/CLID/3362/N/9304/Grill_Screens.html, Printed Feb. 29, 2008, 1 page.

International Search Report and Written Opinion issued Jun. 24, 2009, PCT Appl. No. PCT/US09/43838 filed May 13, 2009, 13 pages.

International Search Report dated Nov. 25, 2005 in corresponding International Application No. PCT/US2005/029918.

Office Action dated Dec. 26, 2008 in corresponding Malaysian Application No. PI 20054111.

Office Action dated Dec. 18, 2007 in U.S. Appl. No. 11/736,498, filed Apr. 17, 2007.

Office Action dated Dec. 23, 2008 in U.S. Appl. No. 11/736,498, filed Apr. 17, 2007.

Office Action dated Jul. 21, 2010 in U.S. Appl. No. 11/923,456, filed Oct. 24, 2007.

"Roof Battens," NASH—National Association of Steel-Framed Housing, http://www.nash.asn.au/whyChooseStStartOwnBuildRoofBatten.php, Printed Mar. 5, 2008, 2 pages.

"Stainless Steel Scrubber—Silver Color," foodservicedirect.com, http://www.foodservicedirect.com/index.cfm/S/107/CLID/3362/N/102336/Stainless_Steel . . . , Printed Feb. 29, 2008, 1 page.

"Synthetic Roof Underlayment," ToolBase Services, http://www.toolbase.org/Technology-Inventory/Roofs/synthetic-roof-underlayment, Printed Mar. 5, 2008, 3 pages.

"Tile Batten," http://www.metrollqld.com.au/minisites/products/tilebatten.html, Apr. 12, 2001, 2 pages.

"Wildland Urban Interface (WUI) Products," California Department of Forestry and Fire Protection—Office of the State Fire Marshall, Published by *CAL-FIRE* Wildland Fire Prevention Engineering, http://osfm.fire.ca.gov/pdf/fireengineering/bml/wuiproducts.pdf, Revised Dec. 28, 2007, 11 pages.

International Search Report and Written Opinion dated Nov. 5, 2012 in Application No. PCT/US2011/030027, filed Mar. 25, 2011.

Office Action mailed Jan. 22, 2013 in Japanese Application No. 2011-509667, filed May 13, 2009.

Office Action in Russian Application No. 2010149942/12, filed May 13, 2009, dated Mar. 21, 2013.

Office Action in Russian Application No. 2010149942/12, filed May 13, 2009, dated Oct. 11, 2013.

Office Action in Australian Application No. 2009246322, filed May 13, 2009, dated Nov. 28, 2013.

Office Action mailed Nov. 26, 2013 in Japanese Application No. 2011-509667, filed May 13, 2009.

* cited by examiner

FIG. 7A1

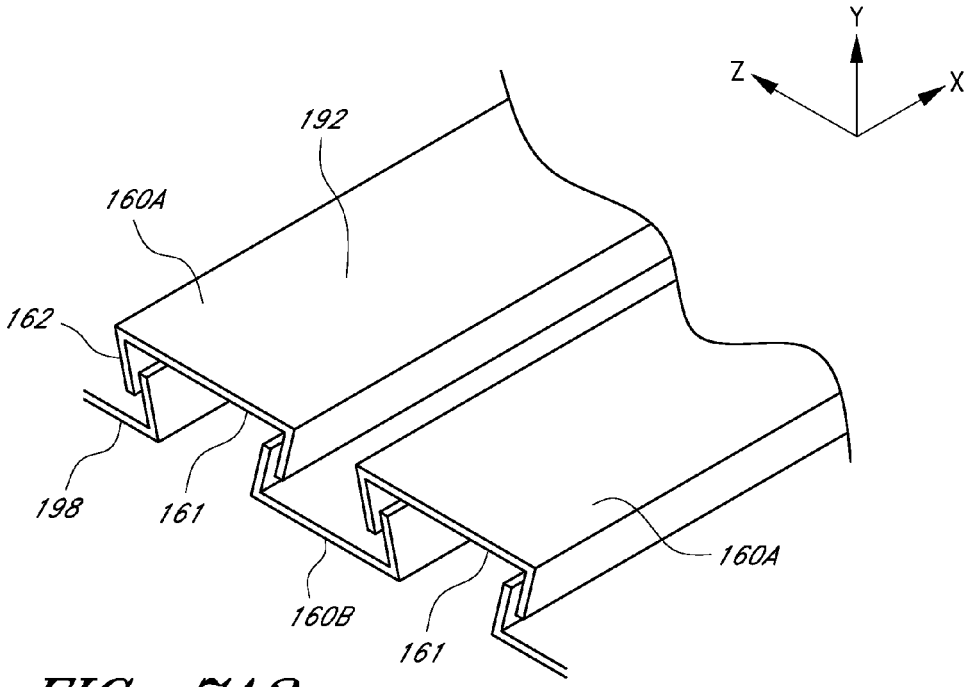
FIG. 7A2
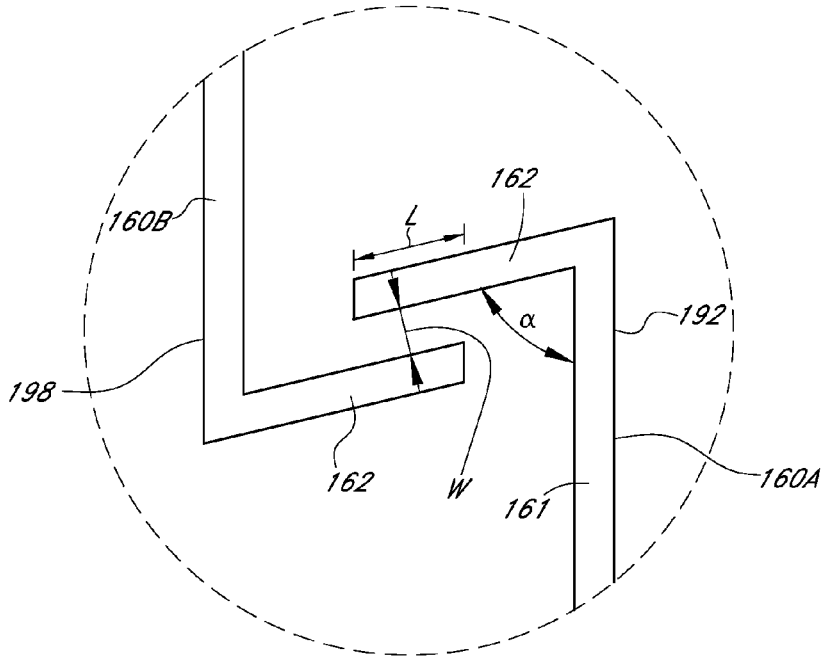
FIG. 7A3

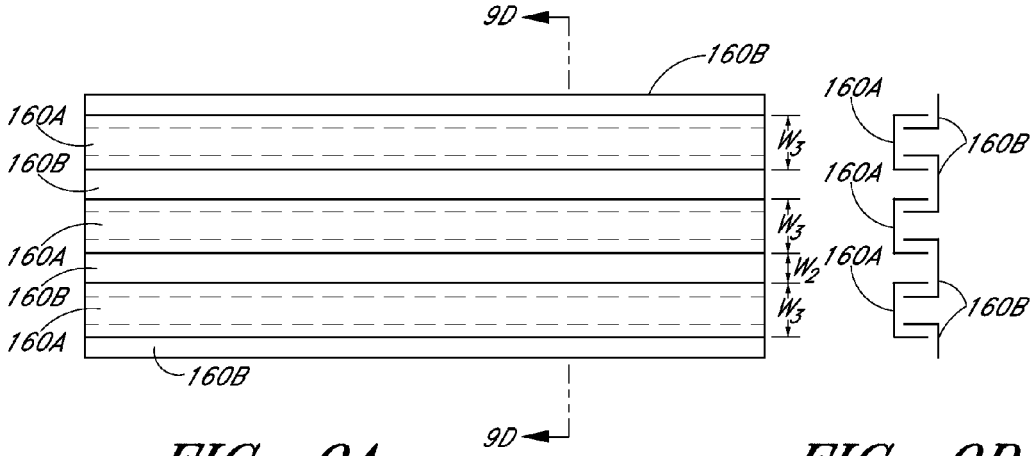
FIG. 9A
FIG. 9D
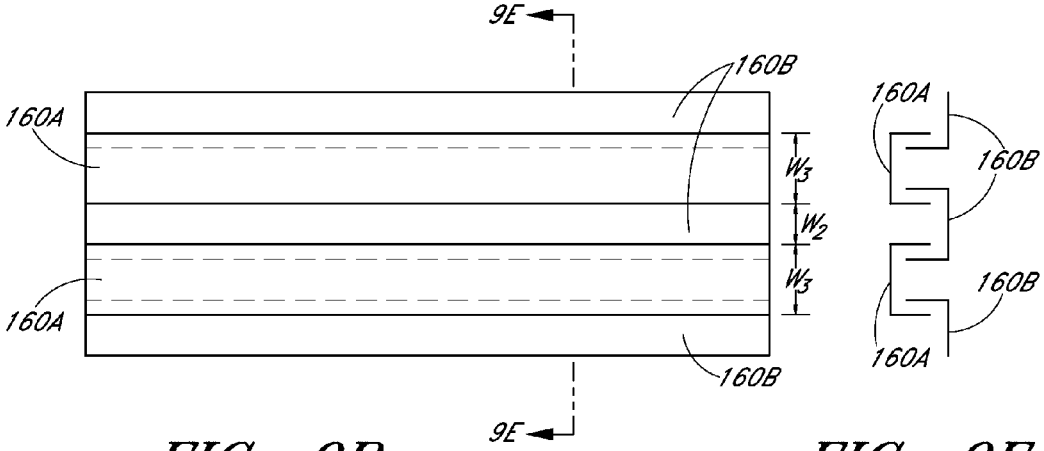
FIG. 9B
FIG. 9E
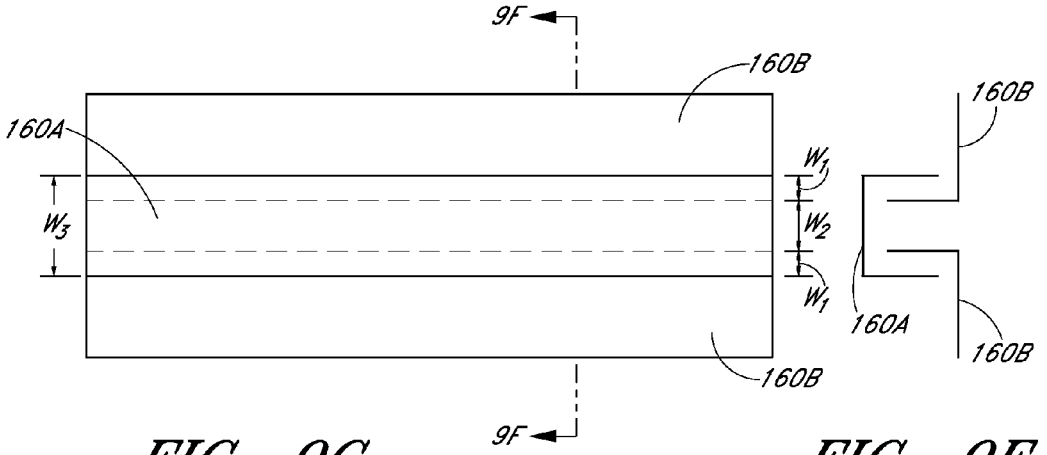
FIG. 9C
FIG. 9F

ABOVE SHEATHING VENTILATION SYSTEM

PRIORITY CLAIM

This application claims the benefit under 35 U.S.C. §119 (e) of U.S. Provisional Patent Application No. 61/386,886 filed Sep. 27, 2010, which is hereby incorporated by reference in its entirety.

BACKGROUND OF THE INVENTION

1. Field of the Invention

The present disclosure relates to ventilation systems, and more particularly to so-called Above Sheathing Ventilation (ASV) systems.

2. Description of the Related Art

Ventilation of a building has numerous benefits for both the building and its occupants. For example, ventilation of an attic space can prevent the attic's temperature from rising to undesirable levels, which also reduces the cost of cooling the interior living space of the building. In addition, increased ventilation in an attic space tends to reduce the humidity within the attic, which can prolong the life of lumber used in the building's framing and elsewhere by diminishing the incidence of mold and dry-rot. Moreover, ventilation promotes a more healthful environment for residents of the building by encouraging the introduction of fresh, outside air. Also, building codes and local ordinances typically require ventilation and dictate the amount of required ventilation. Most jurisdictions require a certain amount of "net free ventilating area," which is a well-known and widely used measure of ventilation.

An important type of ventilation is Above Sheathing Ventilation (ASV), which is ventilation of an area within a roof above the sheathing or roof deck, such as in a batten cavity between the top of the roof deck and the underside of the tiles. Increasing ASV has the beneficial effect of cooling the batten cavity and reducing the amount of radiant heat that can transfer into the structure of the building, such as an attic space. By reducing the transfer of radiant heat into the building, the structure can stay cooler and require less energy for cooling (e.g., via air conditioners).

In many areas, buildings are at risk of exposure to wildfires. Wildfires can generate firebrands, or burning embers, as a byproduct of the combustion of materials in a wildfire. These embers can travel, airborne, up to one mile or more from the initial location of the wildfire, which increases the severity and scope of the wildfire. One way wildfires can damage buildings is when embers from the fire land either on or near a building. Likewise, burning structures produce embers, which can also travel along air currents to locations removed from the burning structures and pose hazards similar to embers from wildfires. Embers can ignite surrounding vegetation and/or building materials that are not fire-resistant. Additionally, embers can enter the building through foundation vents, under-eave vents, soffit vents, gable end vents, and dormer or other types of traditional roof field vents. Embers that enter the structure can encounter combustible materials and set fire to the building. Fires also generate flames, which can likewise set fire to or otherwise damage buildings when they enter the building's interior through vents.

SUMMARY

In accordance with one embodiment, a roof structure comprises a roof deck, a layer of roof cover elements spaced above the roof deck to define an air layer between the roof deck and the layer of roof cover elements, and a plurality of vent members each replacing and mimicking an appearance of one or more roof cover elements in the layer of roof cover elements. Each vent member comprises an opening permitting air flow between the air layer and a region above the vent member. The roof deck does not include any openings that permit air flow between the air layer and a region below the roof deck.

In accordance with another embodiment, a roof structure comprises a roof deck, a layer of roof cover elements spaced above the roof deck to define an air layer between the roof deck and the layer of roof cover elements, and a plurality of vent members each replacing and mimicking an appearance of one or more roof cover elements in the layer of roof cover elements. Each vent member comprises an opening permitting air flow between the air layer and a region above the vent member. At least one of the vent members comprises an ember impedance structure that substantially prevents ingress of floating embers through the opening of the vent member while permitting air flow through the opening. The roof deck does not include any openings that permit air flow between the air layer and a region below the roof deck.

In accordance with yet another embodiment, a vented eave riser comprises a barrier wall and an ember impedance structure positioned proximate to the barrier wall. The barrier wall is adapted to fit between a roof deck and a layer of roof cover elements of a roof. The barrier wall comprises one or more openings permitting air flow through the barrier wall. The ember impedance structure substantially prevents ingress of floating embers through the ember impedance structure, while permitting air flow through the ember impedance structure.

In accordance with still another embodiment, a roof structure comprises a roof deck defining an eave, a layer of roof cover elements spaced above the roof deck to define an air layer between the roof deck and the layer of roof cover elements, and at least one vented eave riser positioned at the eave between the roof deck and the layer of roof cover elements. The vented eave riser comprises a barrier wall and an ember impedance structure. The barrier wall has one or more openings permitting air flow through the barrier wall into the air layer. The ember impedance structure is positioned proximate to the openings and within the air layer.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 7A1 is a cross-sectional view of one embodiment of baffle members for use in a ventilation system.

FIG. 7A2 is a schematic perspective view of a section of the baffle members shown in FIG. 7A1.

FIG. 7A3 is a detail of the cross-sectional view shown in FIG. 7A1.

FIG. 9A is a side view of an embodiment of a baffle system for use in a ventilation system.

FIG. 9B is a side view of another embodiment of a baffle system for use in a ventilation system.

FIG. 9C is a side view of another embodiment of a baffle system for use in a ventilation system.

FIG. 9D is a cross-sectional view of the baffle system of FIG. 9A, taken along line 9D-9D of FIG. 9A.

FIG. 9E is a cross-sectional view of the baffle system of FIG. 9B, taken along line 9E-9E of FIG. 9B.

FIG. 9F is a cross-sectional view of the baffle system of FIG. 9C, taken along line 9F-9F of FIG. 9C.

DETAILED DESCRIPTION

Figure 1:
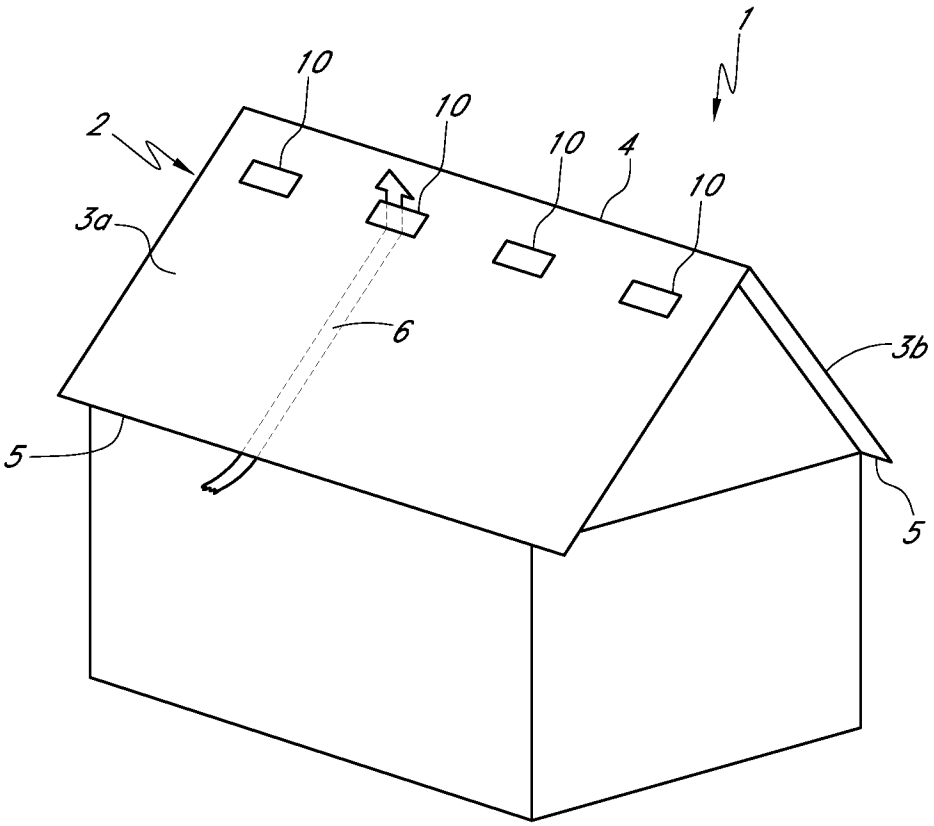
FIG. 1 is a perspective view of a building with a ventilation system in accordance with one embodiment of the present disclosure.

FIG. 1 shows a building 1 with a roof 2 comprising two fields 3*a* and 3*b* that are joined at their upper ends to define a ridge 4. Lower edges 5 of the fields are referred to as "eaves." The fields 3*a* and 3*b* typically comprise a sheathing or roof deck covered with a layer of roof cover elements 105 (FIGS. 2A and 2B), such as tiles (e.g., clay, metal, or concrete), shingles (e.g., wooden, clay, asphalt, or composition), or sheeting (e.g., metal). The sheathing is typically supported by rafters (not shown). The illustrated roof is suitable for having one or more vent members 10 according to one embodiment of the invention. Also, skilled artisans will appreciate that the vent members 10 may be provided in a wide variety of different types of roofs, including those not having ridges or sloped fields.

The roof cover elements 105 and/or the vent members 10 may be supported by a series of battens to create additional airspace beneath the roof cover elements 105 and/or vent members 10. This additional airspace may be referred to as a batten cavity, which is further described below. Air tends to flow into the batten cavity through eave vents or other openings (e.g., soffit vents) along eaves 5, and air tends to exit the batten cavity through the vent members 10. In this arrangement, airflow through the batten cavity may be indicated by the arrow 6.

Figure 2A:
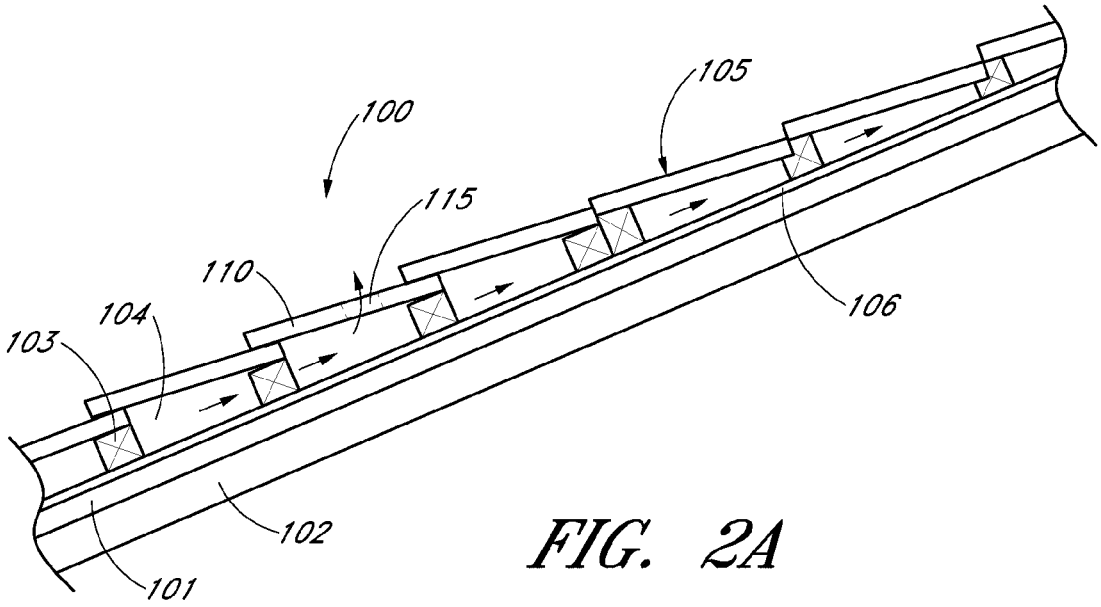
FIG. 2A is a schematic cross-sectional view of a roof section in one embodiment of the present disclosure.

FIG. 2A illustrates a cross-sectional view of an embodiment of a roof structure 100 with arrows indicating airflow. The roof 100 may include a roof deck 101 or sheathing placed over a roof supporting structure 102. The roof supporting structure 102 may comprise rafters. Rafters typically comprise beams that extend perpendicularly to and between the ridge and the eave, and may run in parallel to one another. The roof supporting structure 102 may be formed of wood, metal, and/or other materials. A skilled artisan will appreciate that the configuration of the roof supporting structure 102 can vary depending on the design of a building.

Typically, the sheathing layer or roof deck 101 is installed on the roof supporting structure 102. The sheathing layer 101 may comprise, for example, a wooden roof deck or metal sheeting. The roof cover elements 105 are laid over and across the sheathing layer 101 or, alternatively, directly on the roof supporting structure 102 (if the sheathing layer is omitted). The illustrated roof cover elements 105 comprise tiles which can be flat in shape. In other embodiments, the tiles may be M-shaped or S-shaped, as known in the art, though it is appreciated that other shapes of tiles may be utilized. Details of common M-shaped and S-shaped tiles are disclosed in U.S. Patent Application Publication No. US 2008/0098672 A1, the entirety of which is hereby incorporated herein by reference. A skilled artisan will appreciate that various other types of covering materials can be used for the roof cover elements 105.

In certain embodiments, the roof 100 may further include battens 103 extending parallel to and between the ridge 4 and the eave 5. The battens may be positioned on the sheathing layer 101 or, alternatively, directly on the roof supporting structure 102 (if the sheathing layer is omitted), while supporting the roof cover elements 105. It will be appreciated that various configurations of battens 103 can be adapted for the roof cover elements 105. In general, techniques for using battens to support tiles and other types of covering elements are well known.

Battens 103 may be configured to create an air layer 104 (also referred to as an "air gap" or "batten cavity") between the roof deck 101 and the layer of roof cover elements 105. The air layer 104 permits airflow within the roof 100 to produce ASV. Also, the battens 103 can be configured to permit airflow through the battens (e.g., by having perforations). Such battens are referred to as "flow-through battens." Alternatively or additionally, some or all of the battens 103 may be elevated from the roof deck 101 or other intervening layer(s) by way of spacers or pads (not shown), to permit airflow between the battens and the roof deck. This is referred to as a "raised batten system." Battens that permit the flow of air upslope or downslope through or across the battens are referred to as "cross battens." In some embodiments, the battens 103 can be formed of fire resistant materials. Examples of fire resistant materials that may be appropriate for use in battens include metals and metal alloys, such as steel (e.g., stainless steel), aluminum, and zinc/aluminum alloys. Alternately or in addition to employing fire resistant materials for the battens 103, the battens 103 can be treated for fire resistance, such as by applying flame retardants or other fire resistant chemicals to the battens. Fire resistant battens are commercially available from Metroll of Richlands QLD, Australia.

The roof 100 may also include a protective layer 106, such as a fire resistant underlayment, that overlies the roof deck 101. Thus, the protective layer 106 can be interposed between the roof deck 101 and the roof cover elements 105. Fire resistant materials include materials that generally do not ignite, melt or combust when exposed to flames or hot embers. Fire resistant materials include, without limitation, "ignition resistant materials" as defined in Section 702A of the California Building Code, which includes products that have a flame spread of not over 25 and show no evidence of progressive combustion when tested in accordance with ASTM E84 for a period of 30 minutes. Fire resistant materials can be constructed of Class A materials (ASTM E-108, NFPA 256). A fire resistant protective layer appropriate for roofing underlayment is described in PCT App. Pub. No. WO 2001/040568 to Kiik et al., entitled "Roofing Underlayment," published Jun. 7, 2001, which is incorporated herein by reference in its entirety. In other embodiments, a non-fire resistant underlayment can be used in conjunction with a fire resistant cap sheet that overlies or encapsulates the underlayment. In still other embodiments, the protective layer 106 can be omitted.

Additionally, the layer of roof cover elements 105 may comprise a plurality of non-vent elements (e.g., roof tiles) and a plurality of vent members (also referred to as "secondary vent members," "cover layer vent members," and the like), such as the illustrated vent members 110. Each vent member 110 may preferably replace one or more non-vent elements in accordance with a repeating engagement pattern of the roof cover elements 105 for engaging one another. The vent member 110 may be configured to mimic an appearance of the replaced one or more roof cover elements 105 so as to visually blend into the appearance of the roof 100. In particular, the vent member 110 may have substantially the same shape as that of the replaced one or more roof cover elements 105, for example, tiles or shingles. Furthermore, each vent member 110 preferably includes openings (such as the illustrated openings 115) permitting air flow between the regions above and below the vent member 110, i.e., between the area above the roof and the air gap 104. To reduce the likelihood of ingress of embers or flames through the openings 115, the openings 115 may include one or more baffles as described in U.S. Patent App. Pub. No. 2009/0286463 to Daniels, published Nov. 19, 2009, the entirety of which is incorporated herein by reference.

Figure 2B:
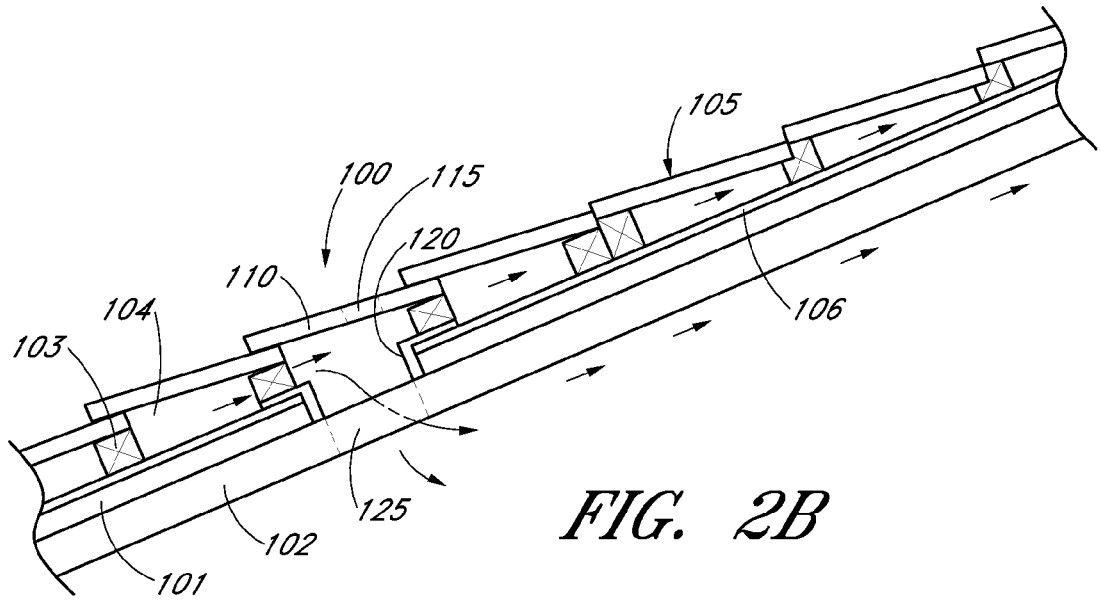
FIG. 2B is a schematic cross-sectional view of another embodiment of a roof section of the present disclosure.

In another embodiment illustrated in FIG. 2B, the roof 100 further comprises primary vent members (such as "subflashings") 120 within the roof deck 101. Each primary vent member 120 may comprise one or more openings 125 to permit air flow between a region below the roof deck 101 (e.g., an attic) and a region above the primary vent members 120 (e.g., batten cavity). The openings 125 may be covered by a screen to prevent ingress of insects, vermin, leaves, and debris larger than the screen openings. The primary vent members 120 may also include one or more baffles to substantially prevent the ingress of embers or flames from passing through the openings 125. The addition of primary vent members 120 may provide further ventilation of air from the attic to the roof vent member 110. In some embodiments, it may be desirable to include more roof vent members 110 than primary vent members 120. Or, as depicted in FIG. 2A, it may be desirable to not include any primary vent members 120 in the roof 100.

Figure 3:
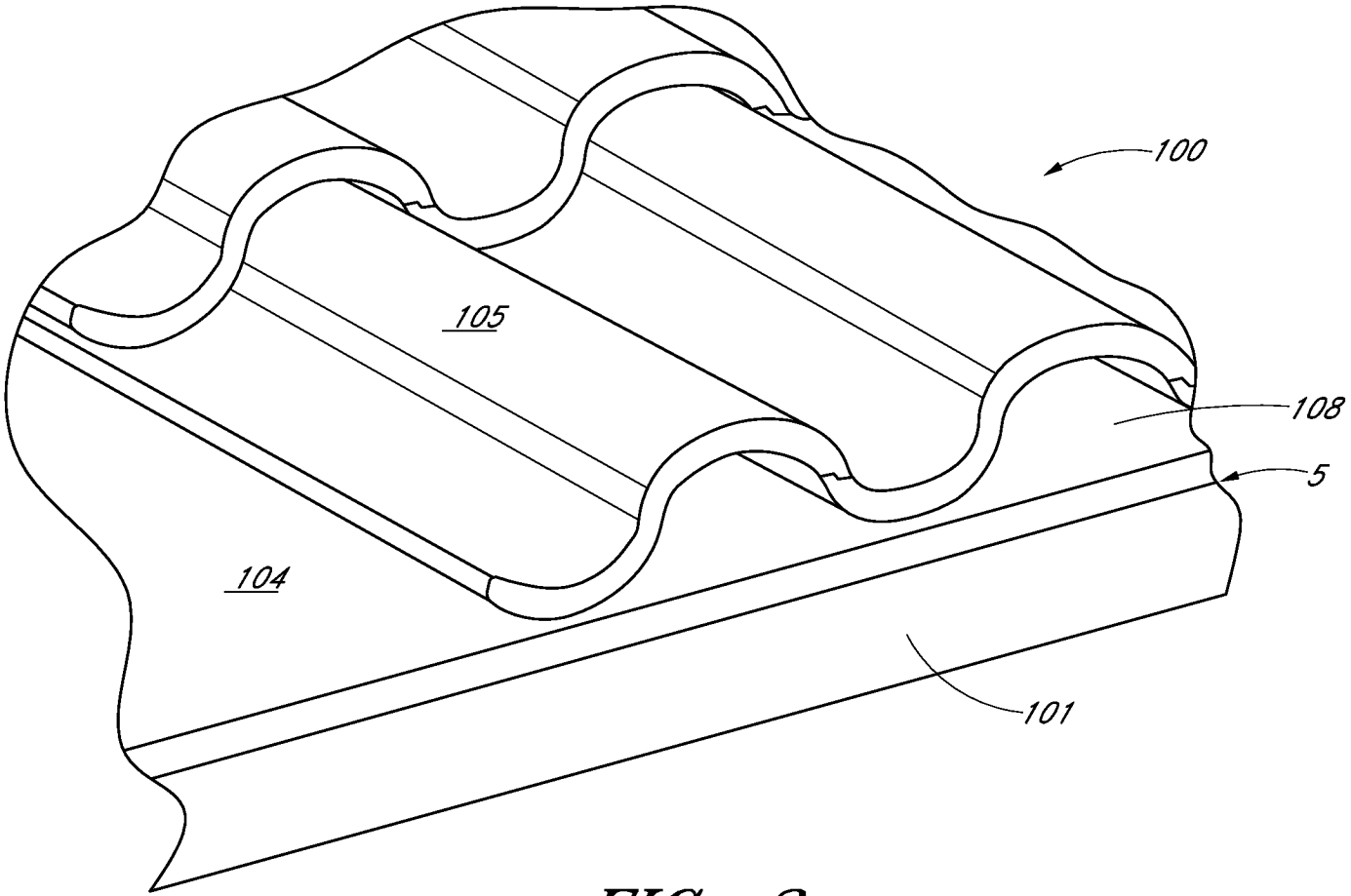
FIG. 3 is a perspective view of an eave portion a roof structure in one embodiment of the present disclosure.

In FIG. 3, an embodiment of a roof structure 100 along eaves 5 is shown. At the edge of the roof structure 100, one or more spaces 108 (typically a plurality corresponding to the number of pan and cap channels in the roof cover element 105 configuration) may be defined between the roof deck 101 and the roof cover elements 105. The size and shape of the space 108 may depend on the profile of the roof cover elements 105. The space 108 can provide passage for airflow from outside of the building 1 into the air layer 104. Typically, a barrier is fitted in the space 108 to provide support for the roof cover elements 105, and to also substantially inhibit the ingress of undesired elements such as insects, vermin, leaves, debris, and wind-driven precipitation. If left open, the space 108 increases the likelihood of the ingress of floating embers or flames to pass through.

Figure 4A:
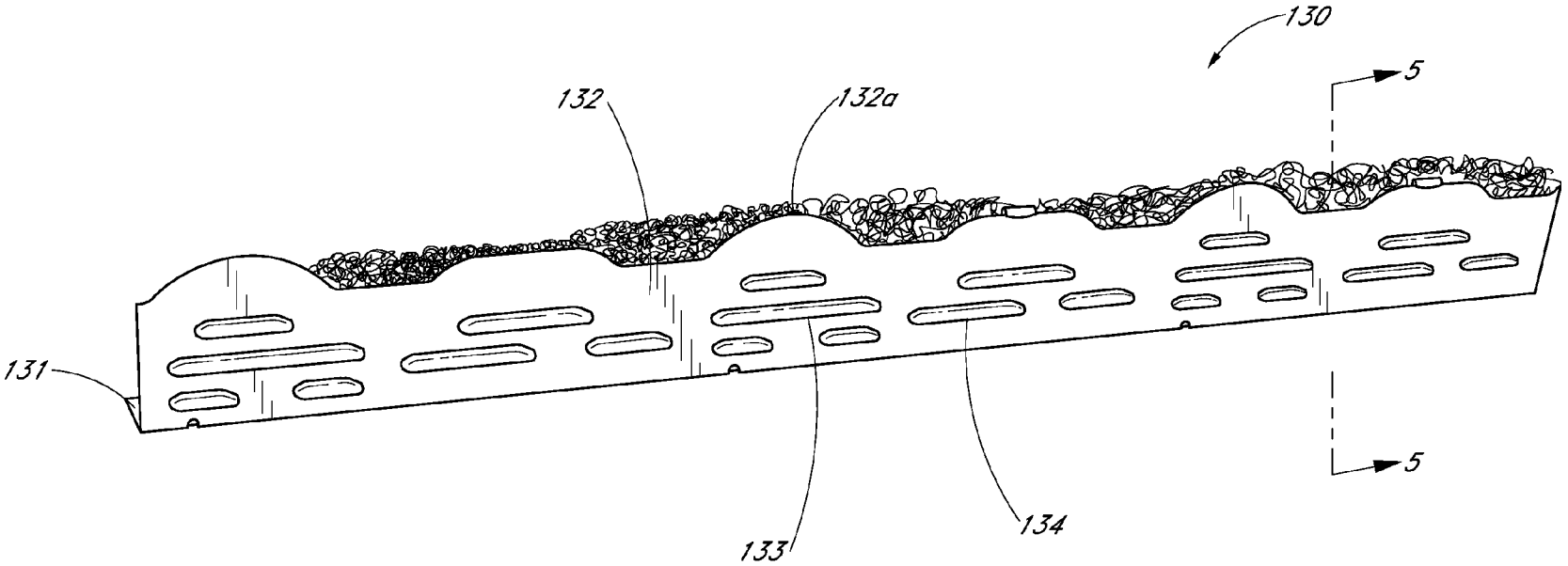
FIG. 4A is a perspective front view of a vented eave riser in accordance with one embodiment of the present disclosure.
Figure 4B:
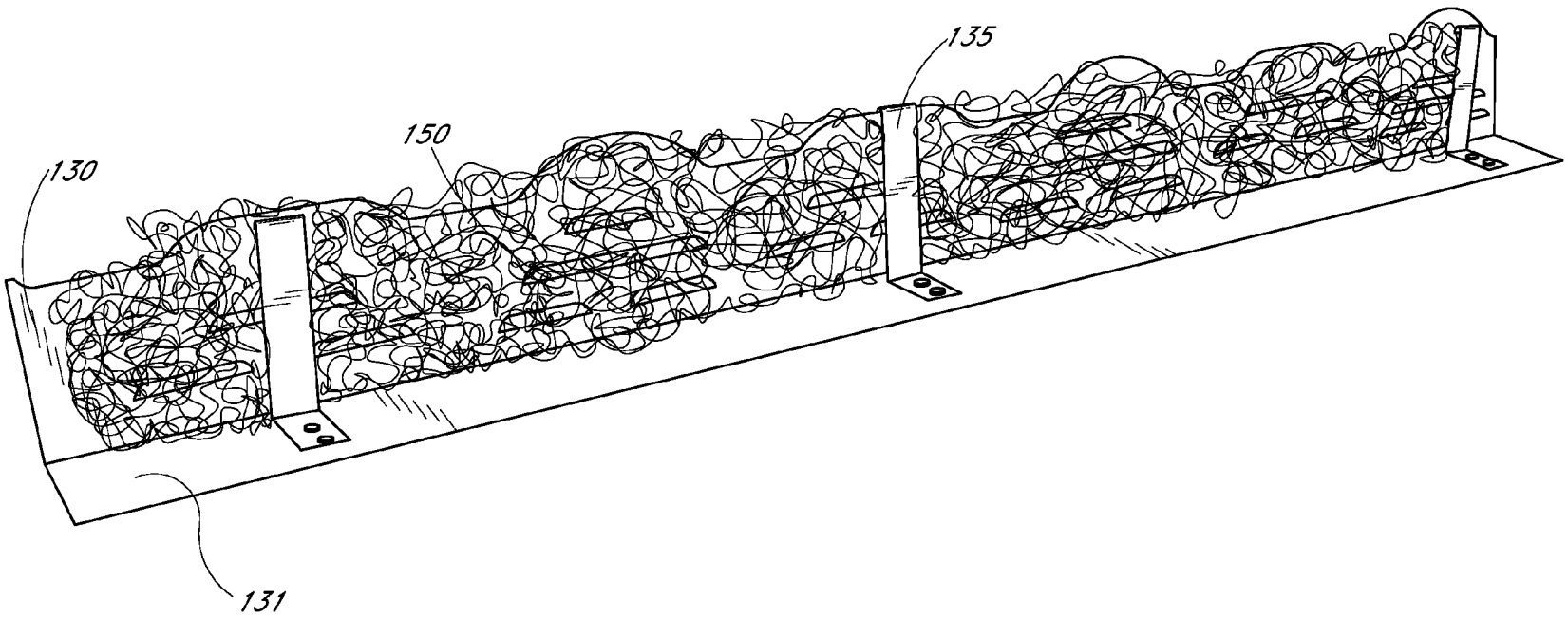
FIG. 4B is a perspective rear view of the vented eave riser of FIG. 4.

FIGS. 4A-4B illustrate an embodiment of a vented eave riser 130. The vented eave riser 130 is adapted to fit between the roof deck 101 and one or more of the roof cover elements 105 (e.g., roof tiles) at or near the eave 5. The vented eave riser includes a base 131 and a barrier wall 132 or panel. The base 131 is generally placed in contact with and substantially parallel to the roof deck 101 or to a layer of material (e.g., protective layer 106 described above), and installed along the eaves 5. The barrier wall 132 may have a sufficient height to extend from the roof deck 101 to contact undersides of the one or more roof cover elements 105 at the eave 5. In some configurations, the barrier wall 132 may be substantially perpendicular to the roof deck 101, or may be offset from the base 131 by an angle.

Generally, the barrier wall 132 has an upper edge 132*a* whose profile substantially matches a profile of the undersides of the roof cover elements 105. The edge 132*a* of the barrier wall 132 may in some embodiments support the roof cover elements 105. By having a profile that substantially matches the profile of the roof cover elements 105, the vented eave riser 130 substantially closes the space 108. As a result, the vented eave riser 130 can substantially inhibit the ingress of undesired elements such as insects, vermin, leaves, debris, wind-driven precipitation, and floating embers or flames into the space 108.

Nevertheless, as illustrated in FIG. 4, the vented eave riser 130 comprises openings 133 to permit ventilation of air through the space 108. The openings 133 can comprise one or more slots, holes, channels, cuts, or apertures in any number of sizes, shapes, or designs. Additionally, each opening 133 may be protected by a louver 134 or overhanging projection. The louver 134 may further impede ingress of undesired elements while still allowing ventilation of air.

The vented eave riser 130 may be made of any suitable material for the outdoor environment. For example, the vented eave riser may be formed of galvanized steel or aluminum.

Figure 5:
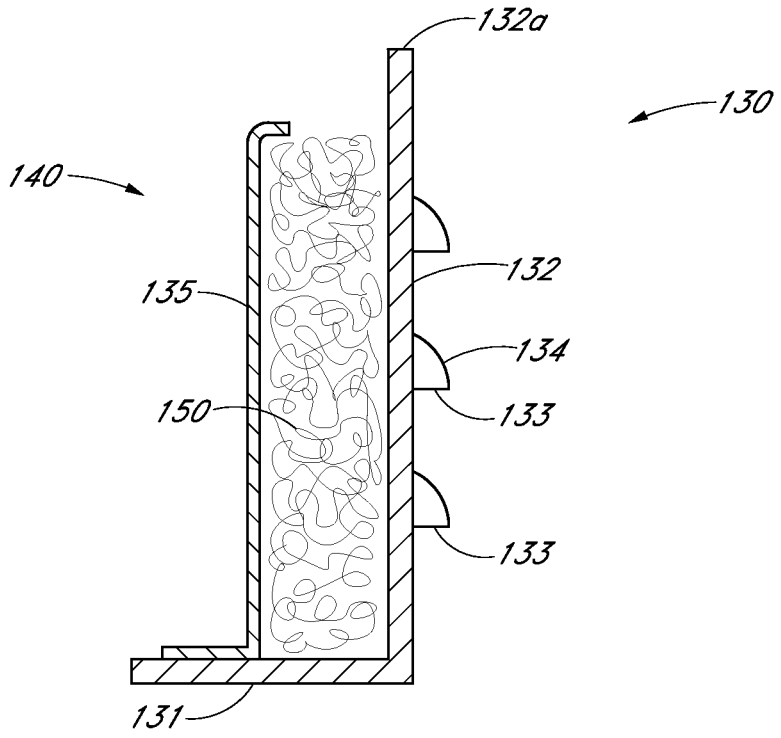
FIG. 5 is a sectional view of the vented eave riser of FIGS. 4A and 4B, taken along line 5-5 of FIG. 4A.

FIG. 5 is a sectional view taken along line 5-5 of FIG. 4A of the vented eave riser. In some embodiments as illustrated in FIG. 5, the vented eave riser 130 may further include an ember impedance structure 140. The goal of preventing the ingress of embers or flames into the building should be balanced against the goal of providing adequate ventilation. One way of striking this balance is to provide an ember impedance structure 140 comprising a mesh material 150 proximate to the openings 133. In FIGS. 4-5, the ember impedance structure 140 comprises mesh material 150 secured to the vented eave riser 130 behind openings 133. In certain embodiments, the mesh material 150 is a fibrous interwoven material. In certain embodiments, the mesh material 150 is flame-resistant. The mesh material 150 can be formed of various materials, one of which is stainless steel. For example, the mesh material 150 can be formed of stainless steel made from alloy type AISI 434 stainless steel, approximately ¼" thick. This particular steel wool can resist temperatures in excess of 700° C. as well as peak temperatures of 800° C. (up to 10 minutes without damage or degradation), does not degrade significantly when exposed to most acids typically encountered by roof vents, and retains its properties under typical vibration levels experienced in roofs (e.g., fan-induced vibration). Also, this particular steel wool provides a net free ventilating area (NFVA) of approximately 133.28 inches per square foot (i.e., 7% solid, 93% open). The concept of NFVA is discussed further in detail below.

The mesh material 150 can be secured to the barrier wall 132 and/or the base 131 by any of a variety of methods. In some embodiments, the vented eave riser 130 includes one or more fingers or other structures 135 extending upward from the base 131 towards the uppermost edge 132*a* of the barrier wall 132, the fingers 135 helping to retain the mesh material 150 against the barrier wall 132. Alternatively, the mesh material 150 can be secured to the barrier wall 132 by other methods including, without limitation, adhesion, welding, and the like.

The mesh material 150 can substantially inhibit the ingress of floating embers while maintaining air flow through the openings 133. Compared to baffle systems described below, the mesh material 150 may provide even greater ventilation. The baffle system restricts the amount of NFVA under the ICC Acceptance Criteria for Attic Vents—AC132. Under AC132, the amount of NFVA is calculated at the smallest or most critical cross-sectional area of the airway of the vent. Sections 4.1.1 and 4.1.2 of AC132 (February 2009) read as follows:

"4.1.1. The net free area for any airflow pathway (airway) shall be the gross cross-sectional area less the area of any physical obstructions at the smallest or most critical cross-sectional area in the airway. The net free area shall be determined for each airway in the installed device."

"4.1.2. The NFVA for the device shall be the sum of the net free areas determined for all airways in the installed device."

With reference to FIGS. 6A-9F, in another embodiment, the vented eave riser 130 may include baffle members 160. Providing baffle members 160 behind the openings 133 can have the effect of reducing the flow rate of air through the openings 133, and enhancing the ember and flame impedance (i.e., the extent to which the baffle members 160 cooperatively inhibit the ingress of flames and floating embers into the air layer 104). In some arrangements, the baffle members 160 are attached to the back of the barrier wall 134.

The baffle members 160 may be oriented in a number of different directions depending on the number, size, and shape of the openings 133. As used herein, the x-axis defines a direction parallel to the eave (or at least the portion of the eave at which the eave riser 130 is positioned), the y-axis defines a direction perpendicular to the eave (or at least said eave portion) and parallel to the roof deck (or at least a portion of the roof deck at which the eave riser 130 is positioned), and the z-axis defines a direction perpendicular to the eave (or at least said eave portion) and perpendicular to the roof deck (or at least said roof deck portion). These orientation descriptions are more easily understood if said eave portion is substantially linear and said roof deck portion is substantially planar. For non-linear eaves and non-planar roof decks, these orientations can refer to tangent lines, tangent planes, and normal lines (e.g., a line tangent to the eave, a plane tangent to the roof deck, a line normal to the roof deck, etc.). In the embodiment shown in FIG. 6A, the baffle members 160 are oriented substantially along the x-axis and are connected at their ends to the barrier wall 132. In other embodiments, the baffle members 160 are oriented along the z-axis, substantially perpendicular to the base 131. It will be understood that more than one baffle member 160 can be provided. For example, FIG. 6B shows two baffle members 160 on one vented eave riser 130.

FIGS. 7A-7D show cross sections of several exemplary baffle members 160. The baffle members 160 in FIGS. 7A-7D can be used in vented eave risers 130 as well as in other implementations, such as in attic vent systems, subflashings, roof vent tiles, and the like. Further, the arrows shown in FIGS. 7A-7D illustrate the flow paths of air passing from one side of the baffle members 160 to the other side of the baffle members 160. Embers or flames outside the baffle members 160 would have to substantially traverse one of the illustrated flow paths in order to pass through the illustrated baffle members 160.

Figure 6A:
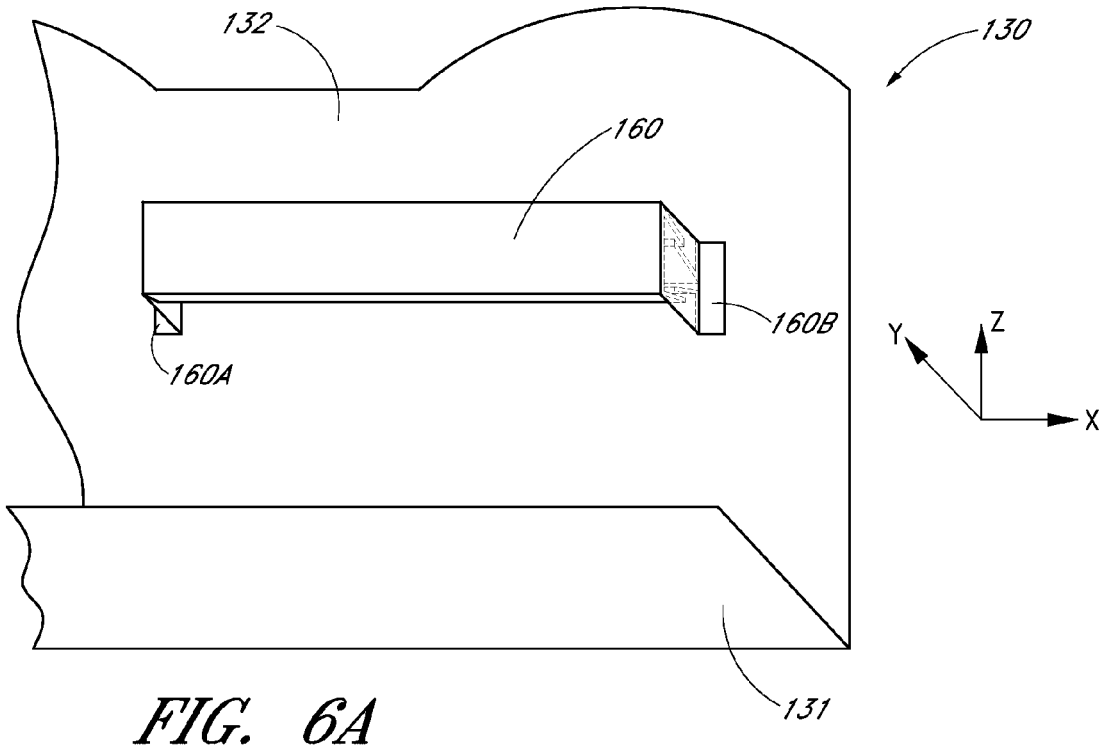
FIG. 6A is a perspective rear view of the vented eave riser in FIG. 4 with a baffle system in accordance with another embodiment of the present disclosure.
Figure 6B:
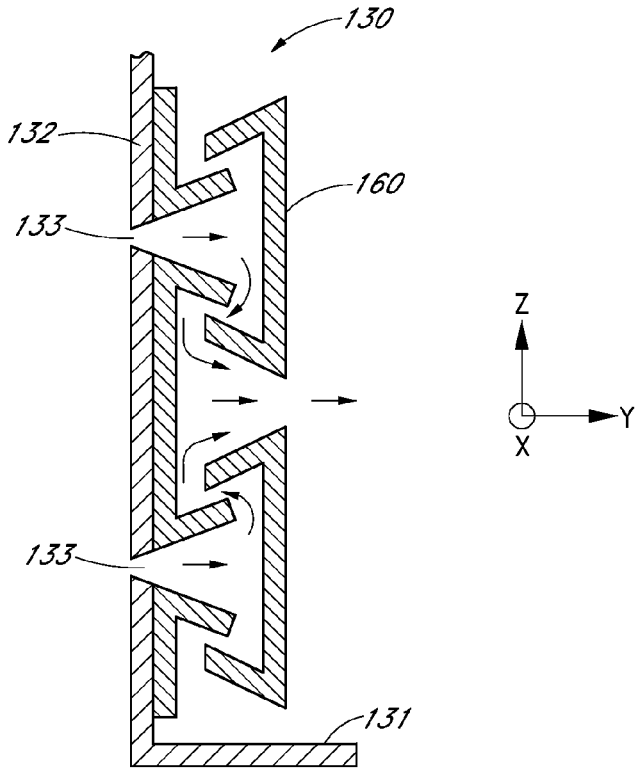
FIG. 6B is a side view of the vented eave riser in FIG. 4 with a baffle system in accordance with another embodiment of the present disclosure.

The baffle members 160 can be held in their positions relative to each other in various ways, such as through their connection with the barrier wall 132 at the ends 160A and 160B of the baffle members 160 (see FIG. 6A). In one implementation, the barrier wall 132 connects (via mechanical fasteners, adhesives, welding, or other suitable means) to the baffle members 160 along some or all of the longitudinal axis, or x-axis, of the baffle members 160, as shown in the side view of FIG. 6B. Moreover, multiple baffle members 160 may be used for one opening 133, and vice versa.

In the embodiment shown in FIGS. 7A1-7A3, air flowing through the baffle members 160 encounters a web or plate portion 161 of a baffle member 160A, and then flows along the web 161 to a passage between flanges or edge portions 162 connected to the webs 161 and 198 (e.g., connected to lateral edges of the webs 161 and 198) of the baffle members 160A and 160B. As shown in FIG. 7A3, air flowing from one side of the baffle members 160 traverses a passage bounded by the flanges 162, the passage having a width W and a length L. In some embodiments, W can be less than or approximately equal to 2.0 cm, and is preferably within 1.7-2.0 cm. In some embodiments, L can be greater than or approximately equal to 2.5 cm (or greater than 2.86 cm), and is preferably within 2.5-6.0 cm, or more narrowly within 2.86-5.72 cm. Also, with reference to FIG. 7A3, the angle $\alpha$ between the webs 161 and the flanges 162 is preferably less than 90 degrees, and more preferably less than 75 degrees.

Figure 7B:
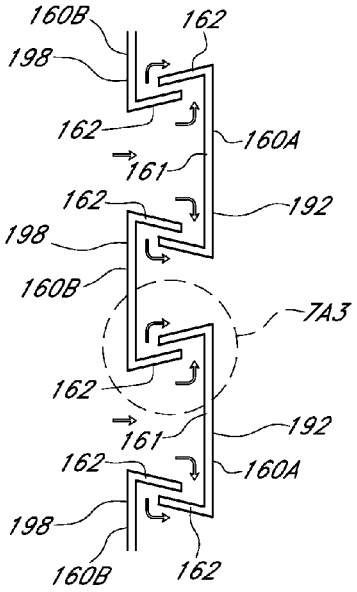
FIG. 7B is a cross-sectional view of another embodiment of baffle members for use in a ventilation system.
Figure 7B:
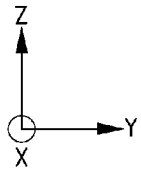
Figure 7B:
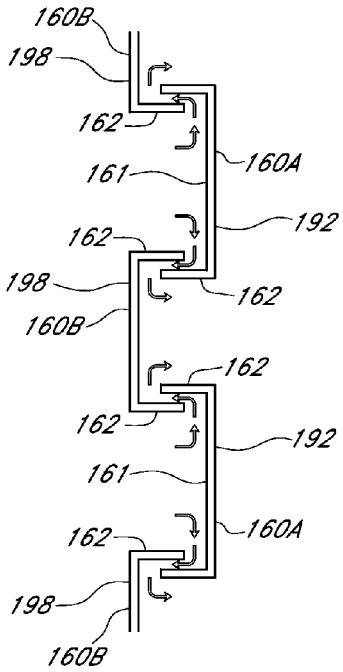

FIG. 7B illustrates a configuration similar to FIG. 7A except that the angle $\alpha$ between the flanges 162 and the web 161 is less severe, such as approximately 85-95 degrees, or approximately 90 degrees. Because the embodiment shown in FIG. 7B requires a less severe turn in the flow path through the baffle members 160, the embodiment of FIG. 7B may be more conducive to greater air flow and less flame and ember impedance than the embodiment shown in FIG. 7A.

Figure 7C:
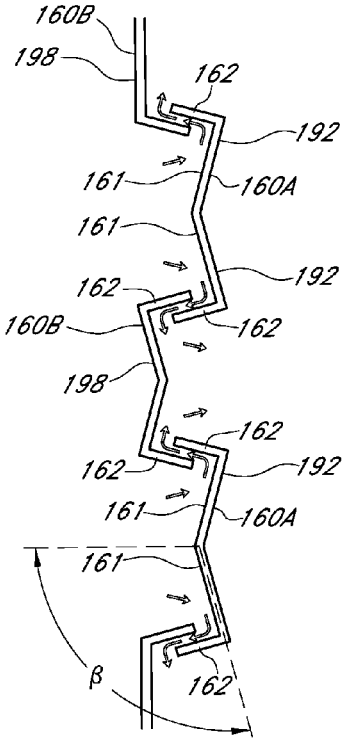
FIG. 7C is a cross-sectional view of another embodiment of baffle members for use in a ventilation system.

In the embodiment shown in FIG. 7C, air flowing generally perpendicularly to the plane of the barrier wall 132 of the vented eave riser 130 and then through the baffle members 160 encounters the web 161 at an angle $\beta$ that is more than 90 degrees (e.g., 90-110 degrees) before flowing into the passages between the flanges 162. The angled web 161 may help to direct the flow of air into the passages between the flanges 162. The angle $\alpha$ between the webs 161 and the flanges 162 in FIG. 7C is preferably between 45 degrees and 135 degrees, and more preferably between 75 degrees and 115 degrees.

Figure 7D:
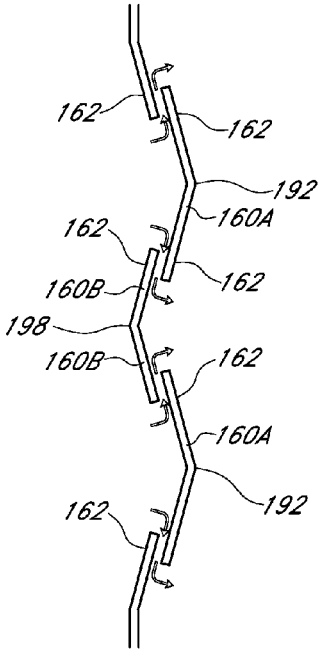
FIG. 7D is a cross-sectional view of another embodiment of baffle members for use in a ventilation system.

The embodiment shown in FIG. 7D employs a V-design for the baffles 160. Air flowing inwardly through the eave riser 130 encounters the outer side of an inverted V-shaped baffle member 160A, and then flows through passages between adjacent baffle members 160A and 160B.

With continued reference to FIGS. 7A-7D, ember and/or flame impedance structures are shown that include elongated inner baffle members 160A and elongated outer baffle members 160B. The elongated inner baffle members 160A can include inner portions 192 and outwardly extending edge portions 162 that are connected to the inner portions 192. In the embodiments shown in FIGS. 7A-7D, the inner portions 192 and the outwardly extending edge portions 162 are substantially parallel to a longitudinal axis (or x-axis) of the inner baffle member 160A. The elongated outer baffle members 160B can include outer plate portions or webs 198 and inwardly extending edge portions 162 that are connected to the outer plate portions 198 (e.g., connected to lateral edges of the outer plate portions 198). In the embodiments shown in FIGS. 7A-7D, the outer portions 198 and the inwardly extending edge portions 162 are substantially parallel to a longitudinal axis (or x-axis) of the outer baffle member 160B.

Further, in the embodiments shown in FIGS. 7A-7D, the longitudinal axes of the inner and outer baffle members 160A, 160B are substantially parallel to one another, and the edge portions 162 of the inner and outer baffle members overlap to form a narrow passage therebetween, such that at least some of the air that flows through the ember and/or flame impedance structure traverses a circuitous path partially formed by the narrow passage. In some embodiments, the at least one narrow passage extends throughout a length (x-axis dimension) of one of the inner and outer baffle members. The at least one narrow passage may have a width (e.g., W in FIG. 7A3) less than or equal to 2.0 cm, and a length (e.g., L in FIG. 7A3) greater than or equal to 2.5 cm. In some embodiments, the x-axes and the z-axes of the inner and outer baffle members 160A, 160B are each configured to be substantially parallel with the plane of the illustrated barrier wall 132 when installed along the eaves 5.

In some embodiments, such as shown in FIGS. 7A-7B, the inner baffle member 160A includes a pair of outwardly extending edge portions 162 connected at opposing sides of the inner portion 192. Further, the outer baffle member 160B can include a pair of inwardly extending edge portions 162 connected at opposing sides of the outer portion 198. The vented eave riser 130 can also include a second elongated inner baffle member 160A configured similarly to the first elongated inner baffle member 160A and having a longitudinal axis that is substantially parallel to the longitudinal axis of the first inner baffle member 160A. One of the edge portions 162 of the first inner baffle member 160A and a first of the edge portions 162 of the outer baffle member 160B can overlap to form a narrow passage therebetween. Further, one of the edge portions 162 of the second inner baffle member 160A and a second of the edge portions 162 of the outer baffle member 160B can overlap to form a second narrow passage therebetween, such that at least some of the air flowing through the ember and/or flame impedance structure traverses a circuitous path partially formed by the second narrow passage.

In some embodiments, the outer baffle member 160B includes a pair of inwardly extending edge portions 162 connected at opposing sides of the outer portion 198. Further, the inner baffle member 160A can include a pair of outwardly extending edge portions 162 connected at opposing sides of the inner portion 192. The vented eave riser 130 can also include a second elongated outer baffle member 160B configured similarly to the first elongated outer baffle member 160B and having a longitudinal axis that is substantially parallel to the longitudinal axis of the first lower baffle member 160B. One of the edge portions 162 of the first outer baffle member 160B and a first of the edge portions 162 of the inner baffle member 160A can overlap to form a narrow passage therebetween. Further, one of the edge portions 162 of the second outer baffle member 160B and a second of the edge portions 162 of the inner baffle member 160A can overlap to form a second narrow passage therebetween, such that at least some of the air flowing through the ember and/or flame impedance structure traverses a circuitous path partially formed by the second narrow passage.

Although FIGS. 7A-7D illustrate some examples of baffle members that may substantially prevent the ingress of embers or flames, skilled artisans will recognize that the efficacy of these examples for preventing the passage of embers or flames will depend in part on the specific dimensions and angles used in the construction of the baffle members. For example, in the embodiment shown in FIG. 7D, the baffle members 160 will be more effective at preventing the ingress of embers or flames if the passages between the baffle members 160 are made to be longer and narrower. However, longer and narrower passages will also slow the rate of air flow through the baffle members. Skilled artisans will appreciate that the baffle members can be constructed so that the ingress of embers or flames is substantially prevented but reduction in air flow is minimized.

The baffle members cause air flowing from one side of the baffle member to another side to traverse a flow path. In some embodiments, such as the configurations shown in FIGS. 7A-7D, the flow path includes at least one turn of greater than 90 degrees. In some embodiments, the flow path includes at least one passage having a width less than or approximately equal to 2.0 cm, or within 1.7-2.0 cm. For example, FIG. 7A3 illustrates a passage width W that preferably meets this numerical limitation. The length L of the passage having the constrained width may be greater than or approximately equal to 2.5 cm, and is preferably within 2.5-6.0 cm. FIG. 7A3 illustrates a passage length L that preferably meets this numerical limitation.

Figure 8:
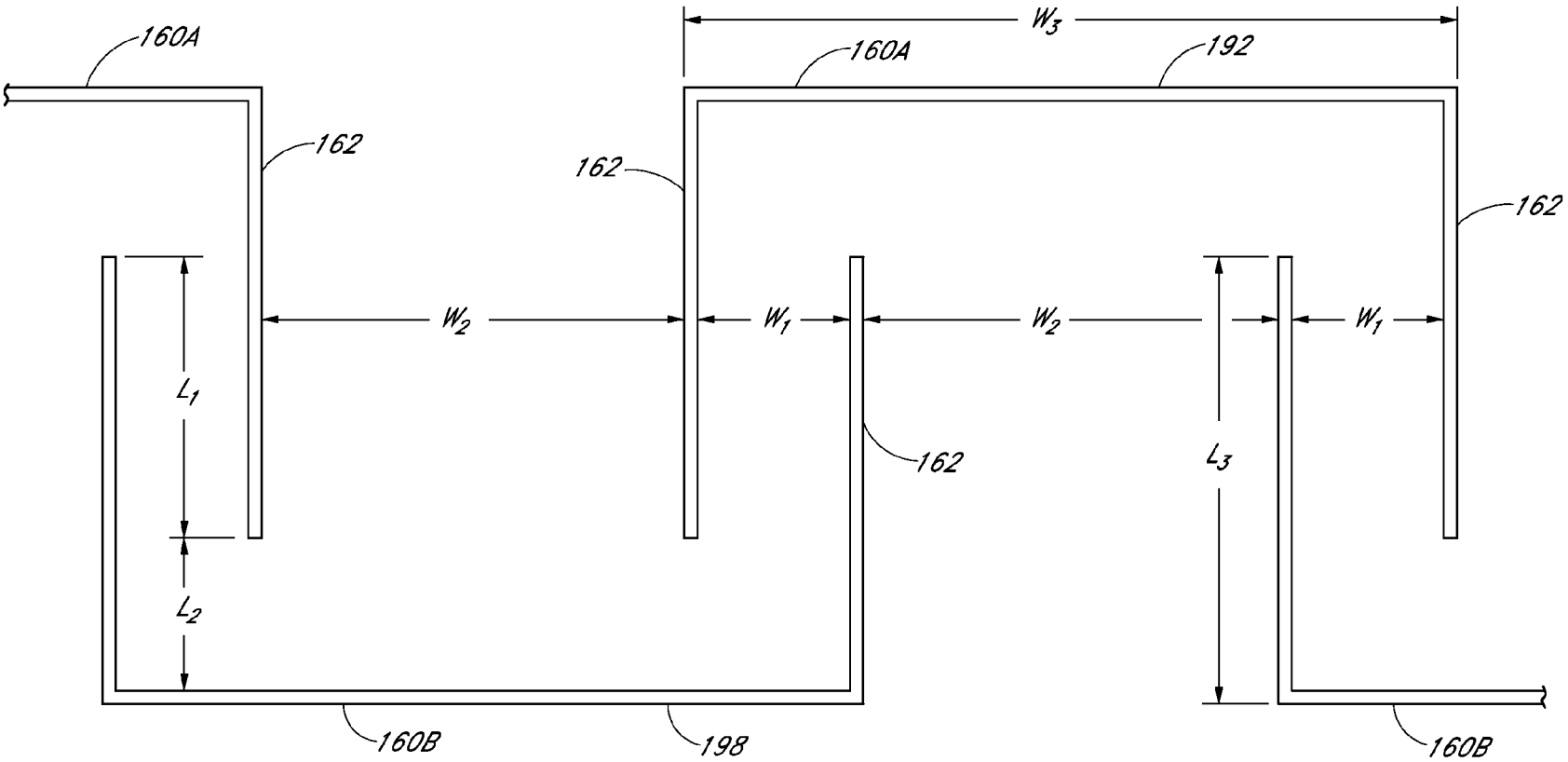
FIG. 8 is a cross-sectional view of another embodiment of baffle members for use in a ventilation system.

A test was conducted to determine the performance of certain configurations of baffle members 160 that were constructed according to the embodiment illustrated in FIG. 8, which is similar to the embodiment illustrated in FIG. 7B. In the test, vents having different dimensions were compared to one another. In each of the vents tested, the width $W_1$ was held to be the same as the length $L_2$, and the width $W_2$ was held to be the same as the length $L_3$. Also, the inner and outer baffle members 160A and 160B were constrained to have the same size and shape as one another. While these tests were conducted for baffle members 160 applied to openings 125 (FIG. 2B) of primary vent members 120, it is believed that the test results are also applicable to or instructive for baffle members 160 applied to vented eave risers 130.

FIGS. 9A-9C show front views of the baffle members tested, and FIGS. 9D-9F show cross sectional side views of the baffle members shown in FIGS. 9A-9C. All three vents had outside dimensions of 19"×7". Because different dimensions were used for the baffle members 160 in the three vents tested, each vent included a different number of baffle members 160 in order to maintain the outside dimensions constant at 19"×7". FIGS. 9A and 9D show a first tested vent in which, with reference to FIG. 8, $W_1$=0.375", $W_2$=0.5" and $W_3$=1.5". FIGS. 9B and 9E show a second tested vent in which $W_1$=0.5", $W_2$=1.0" and $W_3$=2.0". FIGS. 9C and 9F show a third tested vent in which $W_1$=0.75", $W_2$=1.5" and $W_3$=3.0".

The test setup included an ember generator placed over the vent being tested, and a combustible filter media was positioned below the tested vent. A fan was attached to the vent to generate an airflow from the ember generator and through the vent and filter media. One hundred grams of dried pine needles were placed in the ember generator, ignited, and allowed to burn until extinguished, approximately two and a half minutes. The combustible filter media was then removed and any indications of combustion on the filter media were observed and recorded. The test was then repeated with the other vents. Table 1 below summarizes the results of the test, as well as the dimensions and net free vent area associated with each tested vent. Net free vent area (NFVA) is discussed in greater detail below, but for the purposes of the tested vents, the NFVA is calculated as the width $W_1$ of the gap between the flanges 162 of adjacent baffle members 160, multiplied by the length of the baffle members 160 (which is 19" for each of the tested vents), multiplied further by the number of such gaps.

TABLE 1

| Test Vent | $W_1$ (in) | $W_2$ (in) | $W_3$ (in) | $L_1$ (in) | $L_2$ (in) | $L_3$ (in) | NFVA (sq. in.) | Observations of Filter Media After Test |
|---|---|---|---|---|---|---|---|---|
| 1 | 0.375 | 0.55 | 1.5 | 0.375 | 0.375 | 0.75 | 42.75 | Slight discoloration, three small burn holes. |
| 2 | 0.5 | 1.0 | 2.0 | 0.5 | 0.5 | 1.0 | 38 | Heavy discoloration, one large burn hole, five small burn holes. |
| 3 | 0.75 | 1.5 | 3.0 | 0.75 | 0.75 | 1.5 | 28.5 | No discoloration, one small burn hole. Extinguished embers visible. |

Each of the tested vents offered enhanced protection against ember intrusion, as compared to a baseline setup in which the tested vents are replaced with vents that have a screened opening in place of the baffle members 160. The results in Table 1 indicate that the first tested vent had improved performance for prevention of ember intrusion relative to the second tested vent. Moreover, the first tested vent also had a higher NFVA than the second tested vent.

The results in Table 1 also indicate that the third tested vent offers the best performance for prevention of ember intrusion. It is believed that this is due in part to the fewer number of gaps between adjacent baffle members 160 that were present in the third tested vent, which restricted the paths through which embers could pass. Another factor believed to contribute to the ember resistance of the third tested vent is the greater distance embers had to travel to pass through the vent by virtue of the larger dimensions of the baffle members 160, which may provide a greater opportunity for the embers to extinguish. The third tested vent had the lowest NFVA. The results indicate that a vent having a configuration similar to the third tested vent but having still larger dimensions (e.g., $W_1$=1.0", $W_2$=2.0", $W_3$=4.0") would maintain the ember intrusion resistance while increasing the NFVA relative to the third tested vent. The upper bounds for the dimensions of the baffle member will depend on the type of roof on which the vent is employed, the size of the roof cover elements, and other considerations.

The results of this test indicate that, in a primary vent member 120 (FIG. 2B) with an opening 125 significantly larger than width $W_2$ (FIG. 8), having larger baffle members and fewer openings offers greater protection from embers but reduces the NFVA. The results of the test also indicate that, for a baffle member system 160 configured in the manner illustrated in FIG. 8, having smaller baffle members with a greater number of openings can provide greater NFVA and enhanced ember protection relative to a system with mid-sized baffle members and fewer openings.

Consider now the vented eave riser 130 illustrated in FIGS. 4A, 4B, and 5, and assume that it includes baffle members 160, as shown in FIGS. 6A-6B, in place of the mesh 150. The NFVA of the vented eave riser 130 is the area of the opening 133, minus the restrictions to the pathway. In other words, the NFVA is the sum total of the area provided by the baffle members 160. With respect to FIG. 7A3, the NFVA is the sum total of the area provided by the gap W multiplied by the length of the baffle members 160 (i.e., the dimension extending perpendicularly to the plane of the drawing, as opposed to the dimension L), multiplied further by the number of such gaps W (which depends on the number of baffle members).

Contrast that with a vented eave riser 130 as shown in FIG. 5. As noted above, the mesh material 150 can provide a similar level of resistance to the ingress of floating embers, as compared to the baffle members 160. Also, a mesh material 150 comprising stainless steel wool made from alloy type AISI 434 stainless steel provides a NFVA of approximately 133.28 inches per square foot (i.e., 7% solid, 93% open). In contrast, systems employing baffle members 160 are expected to provide, in certain embodiments, about 15-18% open area. The increased NFVA provided by the mesh material 150 can make it possible for a system employing vented eave risers 130 to meet building codes or other rules established (e.g., by local or state fire marshals) for the airflow capacity of eave risers. Typically, building codes that address NFVA are concerned with systems that include attic ventilation. For embodiments where there is no attic ventilation (i.e., an airflow pathway) through the roof from the attic space to the building's exterior, building codes might not regulate airflow through vented eave risers.

Figure 10:
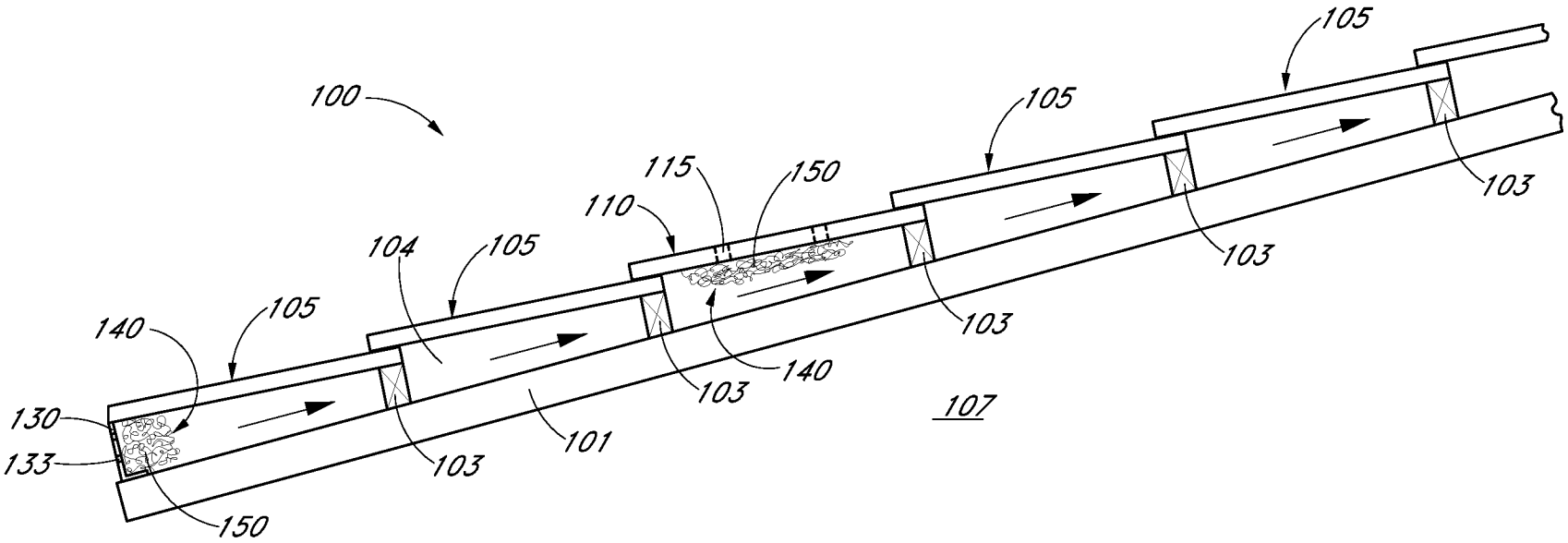
FIG. 10 is a schematic cross-sectional view of a roof section in another embodiment of the present disclosure.

Furthermore, FIG. 10 illustrates a cross-sectional view of a roof structure 100 with multiple ember and/or flame impedance structures 140. While the illustrated impedance structures 140 comprise fibrous meshes 150 as shown, for example, in FIGS. 4A, 4B, and 5, skilled artisans will understand that some or all of the impedance structures 140 can alternatively comprise baffle structures 160 as shown, for example, in FIGS. 6-9. Thus, an impedance structure 140 of a mesh material 150 or a baffle system 160 may be utilized with roof vent members 110 and/or primary vent members 120, in addition to vented eave risers 130. However, in some embodiments, it may be desirable to omit the impedance structure 140 in the roof vent member 110, primary vent member 120, or vented eave riser 130. For example, in FIG. 10, a mesh material 150 is secured to the underside of vent member 110, and another mesh material 150 is secured behind opening 133 of the vented eave riser 130.

In some implementations, as shown in FIG. 10, it may be desirable to omit primary vent members 120 from the roof structure 100 altogether. Such a roof structure 100 may involve a roof deck 101 that does not include any openings 125 (FIG. 2B) that permit air flow between the air layer 104 and a region 107 below the roof deck 101. Such a roof structure 100 provides Above Sheathing Ventilation (ASV) without attic ventilation. Regardless of whether a building provides attic ventilation, providing a vented eave riser in combination with cross battens (e.g., flow-through battens and/or raised batten systems) can greatly enhance energy efficiency and savings by promoting flow of air within a batten cavity. It is believed that ASV can provide energy efficiency benefits even in the absence of attic ventilation.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A roof structure, comprising:

a roof deck;

a layer of roof cover elements spaced above the roof deck to define an air layer between the roof deck and the layer of roof cover elements; and a plurality of vent members each replacing and mimicking an appearance of one or more roof cover elements in the layer of roof cover elements, each vent member comprising an opening permitting air flow between the air layer and a region above the vent member;

wherein at least one of the vent members comprises an ember impedance structure that substantially prevents ingress of floating embers through the opening of the vent member while permitting air flow through the opening;

wherein the roof deck does not include any openings that permit air flow between the air layer and a region below the roof deck;

wherein the ember impedance structure comprises a baffle structure, wherein the baffle structure comprises:

an elongated first baffle member comprising a first plate portion and at least one edge portion connected to a lateral edge of the first plate portion and extending generally away from the first plate portion in a first direction, the first plate portion and the at least one edge portion of the first baffle member being substantially parallel to a longitudinal axis of the first baffle member; and an elongated second baffle member comprising a second plate portion and at least one edge portion connected to a lateral edge of the second plate portion and extending generally away from the second plate portion in a second direction substantially opposing the first direction, the second plate portion and the at least one edge portion of the second baffle member being substantially parallel to a longitudinal axis of the second baffle member;

wherein the longitudinal axes of the first and second baffle members are substantially parallel to one another, and the edge portions of the first and second baffle members overlap to form a narrow passage therebetween, such that at least some of the air that flows through the baffle structure traverses a circuitous path partially formed by the narrow passage.

2. A vented eave riser, comprising:

a barrier wall adapted to fit between a roof deck and a layer of roof cover elements of a roof, wherein the barrier wall comprises one or more openings permitting air flow through the barrier wall; and an ember impedance structure positioned proximate to the barrier wall, the ember impedance structure substantially preventing ingress of floating embers through the ember impedance structure, while permitting air flow through the ember impedance structure, wherein the ember impedance structure comprises a baffle structure comprising:

an elongated first baffle member comprising a first plate portion and at least one edge portion connected to a lateral edge of the first plate portion and extending from the first plate portion away from the barrier wall, the first plate portion and the at least one edge portion of the first baffle member being substantially parallel to a longitudinal axis of the first baffle member; and an elongated second baffle member comprising a second plate portion and at least one edge portion connected to a lateral edge of the second plate portion and extending from the second plate portion toward the barrier wall, the second plate portion and the at least one edge portion of the second baffle member being substantially parallel to a longitudinal axis of the second baffle member;

wherein the longitudinal axes of the first and second baffle members are substantially parallel to one another, and the edge portions of the first and second baffle members overlap to form a narrow passage therebetween, such that at least some of the air that flows through the baffle structure traverses a circuitous path partially formed by the narrow passage.

* * * * *